United States Patent [19]

Wilkinson

[11] Patent Number: 4,529,355

[45] Date of Patent: Jul. 16, 1985

[54] COMPRESSOR SHROUDS AND SHROUD ASSEMBLIES

[75] Inventor: Wilfred H. Wilkinson, Turnditch, England

[73] Assignee: Rolls-Royce Limited, London, England

[21] Appl. No.: 696,883

[22] Filed: Jan. 31, 1985

Related U.S. Application Data

[63] Continuation of Ser. No. 471,520, Mar. 2, 1983, abandoned.

[30] Foreign Application Priority Data

Apr. 1, 1982 [GB] United Kingdom ..... 8209640

[51] Int. Cl.[3] ..... F01D 11/00

[52] U.S. Cl. ..... 415/174; 415/170 R; 415/173 R

[58] Field of Search ..... 415/174, 170 R, 173 A, 415/173 R, 113, 190

[56] References Cited

U.S. PATENT DOCUMENTS

| | | | |
|---|---|---|---|
| 2,927,724 | 3/1960 | Wardle | 415/174 |
| 3,056,583 | 10/1962 | Varadi et al. | 415/170 R |
| 3,146,992 | 9/1964 | Farrell | 415/174 |
| 3,425,665 | 2/1969 | Lingwood | 415/174 |
| 3,583,824 | 6/1971 | Smuland | 415/174 |
| 3,703,808 | 11/1972 | Stearns | 415/174 |
| 3,966,354 | 6/1976 | Patterson | 415/174 |
| 4,472,108 | 9/1984 | Pask | 415/174 |

FOREIGN PATENT DOCUMENTS

| | | |
|---|---|---|
| 868848 | 5/1961 | United Kingdom . |
| 881880 | 11/1961 | United Kingdom . |
| 1497619 | 1/1978 | United Kingdom . |
| 2038956 | 7/1980 | United Kingdom . |
| 2061396 | 5/1981 | United Kingdom . |

*Primary Examiner*—Robert E. Garrett
*Assistant Examiner*—John Kwon
*Attorney, Agent, or Firm*—Cushman, Darby & Cushman

[57] ABSTRACT

To minimize leakage of high pressure compressor air from the high pressure side of an aixal flow compressor rotor back to the low pressure side by the outside of a ring of shroud segments, the shroud segments, or at least their front and rear edge portions, are made relatively thin and springy and are retained to a carrier ring so that those edge portions are held sprung against circumferentially extending sealing lands on the supporting structure. It is arranged that the bending in the shroud segments is effective to accommodate predetermined manufacturing tolerances in the shroud segments and the supporting structure, thus avoiding unwanted clearances at the sealing lands. Alternatively, or in addition, the bending can accommodate reductions in bending due to differential expansion between the components during operation of the compressor rotor at elevated temperatures.

6 Claims, 3 Drawing Figures

COMPRESSOR SHROUDS AND SHROUD ASSEMBLIES

This is a continuation of application Ser. No. 471,520, filed Mar. 2, 1983, which was abandoned upon the filing hereof.

The present invention relates to shrouds and shroud assemblies for the high pressure stages of axial flow compressors such as are incorporated in gas turbine aeroengines.

Axial flow compressor rotor-blade stages operating at high compressor gas temperatures in gas turbine aeroengines are now being provided with specially designed shroud rings for the purpose of maintaining more nearly optimum clearances between the tips of the rotor blades and the shrouds over as wide a range of compressor speeds and temperatures as possible. This is important because over-large blade tip clearances reduce the efficiency of the compressor, whilst clearances which are too small risk causing damage to the compressor under some conditions due to interference between the blade tips and the shroud ring.

A known method of maintaining optimum blade tip clearances over a wide range of conditions involves matching the thermal response of the shroud ring, in terms of increase or decrease of diameter with compressor operating temperature, to the radial growth or shrinkage of the compressor rotor due to changing centrifugal forces and temperatures. To better achieve the required matching, thought is now being given to compressor shroud rings composed of quite a large number of segments, each describing a relatively short arc length circumferentially of the rotor stage, this being anologous to some present-day high-temperature axial flow gas turbine designs.

The shroud segments must be individually connected to supporting structure circumferentially surrounding the shroud ring, and one problem which arises in such designs is excessive sealing clearances between the shroud segments and supporting structure. These excessive clearances can arise because of manufacturing tolerances in the production of the shroud segments and the supporting structure, and because of differing thermal expansion or expansion rates between the two types of components as the compressor operating temperatures change. The excessive clearances cause decreased efficiency in the compressor because, for example, they allow air on the high pressure side of the rotor to leak back between the shroud segments and the supporting structure to the low pressure side of the rotor.

The present invention seeks to alleviate the above problem by providing means whereby the manufacturing tolerances, and even the differing thermal characteristics, can be accommodated.

Accordingly, the present invention provides a shroud assembly for an axial flow compressor rotor in which supporting structure circumferentially surrounds a shroud ring comprising a plurality of resiliently bendable shroud segments and the shroud segments are connected to the supporting structure in such a way that circumferentially extending portions of the shroud segments near their axially opposed edges are sprung against seal means on the supporting structure so as to provide a seal between confronting portions of the supporting structure and the shroud segments, whereby the shroud segments are held in the assembly in a bent condition. The bending may be effective to accommodate predetermined manufacturing tolerances in the shroud segments and the supporting structure which could otherwise cause unwanted clearances between the seal means and the shroud segments. Alternatively, or in addition, the bending is effective to accommodate at least most of any reduction in bending of the shroud segments due to predetermined differential thermal expansion between the shroud segments and the supporting structure during operation of the compressor rotor at elevated temperatures, which differential expansion could otherwise cause unwanted clearances between the seal means and the shroud segments.

Further aspects of the invention will be apparent from the following description of specific embodiments of the invention and the appended claims.

Embodiments of the invention will now be described by way of example only and with reference to the accompanying drawings, in which.

The drawings are not to scale.

Figure 1:
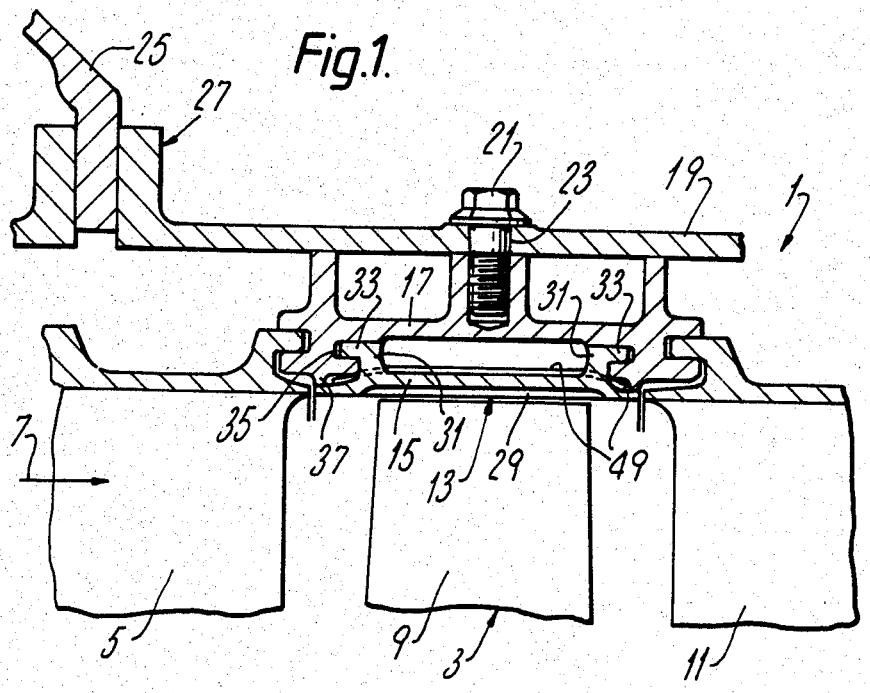
FIG. 1 is a sectional side elevation of part of a high pressure compressor in a gas turbine aeroengine, incorporating a shroud assembly according to the invention.

In FIG. 1, a high pressure compressor 1 comprises a plurality of rotor blade stages, only one of which is shown, at reference 3. Rotor blade stage 3 is preceded by stator blades 5, which direct compressor gases 7 into the rotor blades 9 of rotor stage 3 at a suitable angle. Rotor blades 9 do work on the compressor gases 7, compressing them to a higher pressure and passing them on to succeeding stator blades 11, which in turn deflect the gases onto a further rotor stage. Only the radially outer portions of the blades are shown.

Rotor stage 3 is circumferentially surrounded by a shroud ring 13 comprising a number of shroud segments 15. The shroud segments 15 are connected to supporting structure in the form of a carrier ring 17, which in turn is attached to a compressor casing member 19 by means of a number of circumferentially spaced bolts 21 passing through holes 23 in the casing. Casing member 19 is itself supported from an outer casing (not shown) of the engine by a frustoconical panel 25 and bolted flanges 27.

The function of the shroud ring 13 and carrier ring 17 acting together is to maintain an optimum clearance between the tips of the rotor blades 9 and the inner surfaces of the shroud segments 15. The smaller the gap which can be safely maintained between the blade tips and the shroud segments, the less leakage there will be over the tip of the blades between their high pressure and low pressure flanks, and the greater will be the efficiency of the compressor. A known method of maintaining an optimum clearance is so to design the panel 25, casing member 19, carrier ring 17, and shroud ring 13, that as they expand and contract due to changing temperatures during operation of the compressor, their collective influence on the diameter of the shroud ring 13 causes the increase or decrease of that diameter to match, at least approximately, the radial growth or shrinkage of the compressor rotor 3 due to centrifugal forces and temperature changes. Exact matching of expansion or contraction under all conditions of operation is not possible using this method and so in order to allow the blade tips and shroud segments to come into contact with each other without damage which is significantly deleterious to compressor performance, the inner surfaces of the shroud segments 15 are provided with abradeable linings 29, which can be worn away by the blade tips without structural damage to either the blades or the shroud segments.

In the present design the shroud ring 13 is composed of a number of segments 15 to allow for better control of the necessary changes in its diameter, each segment describing a relatively short arc length. The carrier ring 17 may also be segmented if necessary, the carrier segments being of greater arc length than the shroud segments, e.g. such that each carrier segment carries three or four shroud segments.

Each carrier segment is held to casing member 19 by means of only one of the bolts 21, each bolt being positioned centrally of the circumferential span of each carrier segment so that circumferential expansion and contraction of the segments relative to the casing does not impose shearing forces on the bolts. Differential expansion and contraction between the carrier segments and the casing in the radial sense is accommodated by elastic deformation of the bolt and threads.

The shroud segments 15 are connected to carrier ring 17 by means of circumferentially extending discontinuous "hook" flanges or rows of lugs 31 (see also FIG. 2) which project from the outer sides of the shroud segments near their axially opposed (i.e. front and rear) edges, portions 33 of the lugs 31 being oriented to extend parallel to the inner surface of the shroud ring for reception in annular grooves 35 in the carrier ring. Discrete lugs 31 are used rather than continuous flanges in order to cut down conductive heat transfer between the shroud segments 15 and the carrier ring 17 and also to reduce segment bending due to differential thermal effects.

The shroud segments 15 are made of a superalloy material and in accordance with the invention are resiliently bendable, this being achieved in FIG. 1 by making the shroud segments thin enough near their front and rear edges to be somewhat springy. In addition, lugs 31 are of such radial extent that the thin portions of the shroud segments near their front and rear edges are sprung against circumferentially extending sealing lands 37, which are therefore effective to seal between the confronting portions of the carrier ring and each of the shroud segments, i.e. lugs 31 are radially short enough to hold the shroud segments 15 in the assembly so that they are in a bent condition at their front and rear edges. This is desirable in order to ensure that the seal between the shroud segments and the carrier ring, which helps to prevent leakage of compressor gases from the high pressure side via the spaces between the outer side of the shroud segments and the carrier ring 17, is maintained against the effect of manufacturing tolerances in the shroud segments and the supporting structure.

The effect of manufacturing tolerances can, for example, be to increase or decrease the radii of curvature of the front and rear edge portions of the shroud segments, or the radii of curvature of the sealing lands 37, from their nominal value. Similarly critical dimensions of lugs 31 or grooves 35 can also vary from their nominal values. Hence, it would be possible for tolerances—in the absence of an amount of bending in the shroud segments which is adequate to accommodate them—to cause clearances at the sealing lands 37 between the shroud segments and the carrier ring, thus allowing compressor gases to escape and reduce the efficiency of the engine. In designing the assembly, therefore, a nominal degree of bending is specified for the shroud segments as assembled to the carrier ring, this nominal degree of bending being sufficient to accommodate variations in the actual degree of bending due to the manufacturing tolerances. The actual degree of bending in each segment is of course the nominal degree of bending, with a deviation from nominal caused by the actual variations in dimensions within the tolerances.

Besides making allowance for manufacturing tolerances, it is advantageous to ensure that the seal is maintained against the effect of differential thermal expansion between the shroud segments and the carrier ring. Differential expansion arises because:

(a) the shroud segments and the carrier ring may be made from different alloys, and so may have different coefficients of thermal expansion;
(b) the shroud segments and the carrier ring will be at somewhat different temperatures during operation of the compressor; and
(c) the shroud segments and the carrier ring may expand or contract at differing rates due to the fact that they have different thermal masses, i.e. different thermal inertias.

Such differential expansion, it will be seen, could well open up clearances between the shroud segments and the sealing lands 37, and in order to accommodate them, it can be arranged that the nominal degree of bending in the segments when assembled to the carrier ring (i.e. in the cold-assembled condition) is sufficient to accommodate not only the manufacturing tolerances, but also as much as possible (preferably all) of any reduction in bending of the shroud segments due to known differential expansion effects caused by operation of the compressor. It is, of course, also necessary to ensure that the nominal degree of bending is such as to accommodate any increase in bending due to differential expansion effects, without overstraining the shroud segments. Again the actual degree of bending in the shroud segments when held in the assembly at room temperature will be the nominal degree of bending, with a deviation from that nominal degree due to actual variations in dimensions within manufacturing tolerances.

Figure 2:
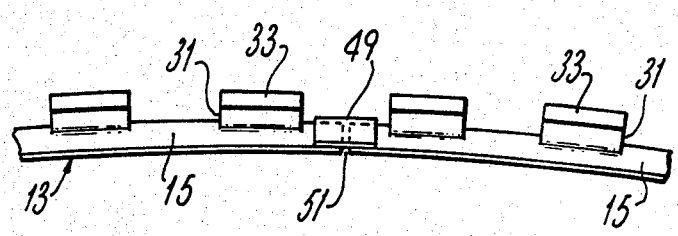
FIG. 2 is a front elevation of a pair of shroud segments seen in isolation from other structure.

In the embodiment of FIGS. 1 and 2, it is ensured that most, if not all, of the bending of the shroud segments occurs near their axially opposed (i.e. front and rear) edges by means of two expedients: firstly, the portions of the shroud segments near their front and rear edges are of reduced thickness relative to the portions inbetween; and secondly, the provision of encastré lugs 31 near the front and rear edges of the shroud segments ensures that the bending loads are reacted between the lugs and the support structure without any substantial bending of the portions of the shroud segments between the front and rear lugs, the bending being confined substantially to the edge portions.

Figure 3:
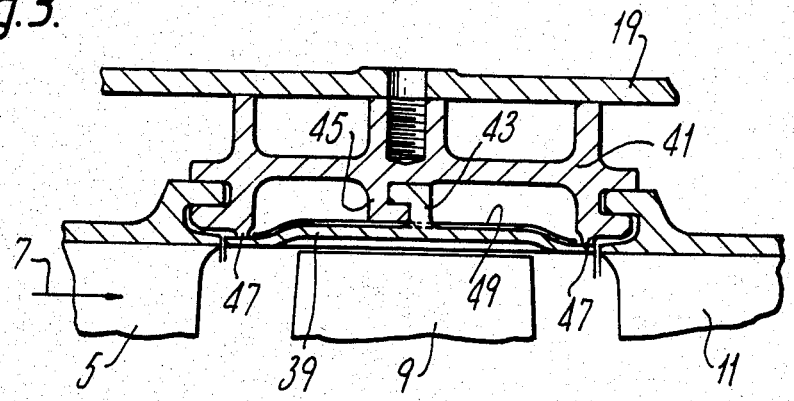
FIG. 3 is a view similar to FIG. 1, showing an alternative embodiment of the invention.

An alternative arrangement is shown in FIG. 3, in which components which are identical to those shown in FIG. 1 are given the same reference numbers and will therefore not be described again. It will easily be seen that the only differences are concerned with the mode of attachment of the shroud segments 39 to the carrier ring, this being achieved by means of a single circumferentially extending row of "hook" lugs 43 provided on the shroud segments 39. Positive location of the shroud segments against movement in the axial rearward direction is provided by the rear edges of segments abutting the front edge of the adjacent stator blade platforms.

As before, it is arranged that the dimensions of the lugs 43 on the shroud segments 39 and flange 45 on the carrier ring 41 are such that the front and rear edges of the shroud segments 39 are pulled against circumferentially extending sealing lands or lips 47 provided on the carrier ring 41. Again, as before, the front and rear edge portions of each shroud segment are somewhat thinner than the rest of the span, so that a large proportion of the bending of the shroud segments due to their being sprung against the sealing lands, occurs in those edge portions. However, in distinction from the arrangement of FIG. 1, the provision of only a central row of lugs 43 ensures that, depending on the thickness of the edge portions in relation to the rest of each shroud segment, the bending can be shared as required over substantially the entire axial span of the segments. This can be useful in cases where large degrees of bending are necessary to accommodate large differences in expansion.

During design of embodiments such as those shown in FIGS. 1 to 3, account must be taken of the effect of the bending of the shroud segments on the shape of their inner surfaces. Thus, the segments may be manufactured with an inner surface which, as in FIGS. 1 to 3, is the correct shape only when the shroud segments are installed in the assembly and are at a certain steady-state condition, such as during the cruise part of the operational cycle of an aeroengine.

Shroud segments with rows of mounting lugs near their front and rear edges, as in FIG. 1, will be must stiffer and resistant to deformation by bending than those with only a central row of lugs, as in FIG. 3. In both cases there have to be enough lugs to ensure that the segments remain circular, controlled by the much greater stiffness of the carrier ring and the casings. Deflections of the front and rear edges of the shroud segments can be minimized by holding close tolerances during manufacture, but in any case the interference between the edges of the shroud segments and the carrier ring will not only result in deformation of the shroud segments by bending, but will also put some circumferential compression into them, because they are parts of circles. This ensures that bending stresses will be lower than might initially be assumed.

During operation of the compressor, it may be that the front and rear edge portions of the shroud segments will get hotter than the main portions of the segments. Too much temperature difference would cause distortion of the segments due to differential thermal expansion between the edges and the middle portions, but higher edge temperatures would be at least partially relieved by conduction in to the carrier ring along the sealing contact between them. If necessary the seal lining material 29 (FIG. 1) could be extended fore and aft as insulation, or a heat barrier coating could be applied to the edge portions.

Besides sealing between the carrier ring and shroud segments, it is also necessary to seal between the adjacent shroud segments themselves. FIGS. 1 to 3 show one method of achieving this, in which the springy strips 49 of a suitable metallic alloy, conforming to the shape of the outer surface of the shroud segments, have one side fixed by brazing or welding to the outer surface of one of each pair of adjacent shroud segments and extend across the clearances 51 (FIG. 2) between segments so that their free (unfixed) sides are in sliding contact with the outer surface of the other segment in each pair. It will be noted that the so-called "strip seals" 49 extend over substantially the whole axial spans of the segments between the sealing lands 37 or 47. By making the shroud segments thicker, the strip seals could alternatively be incorporated in complementary slots provided in the confronting edges of adjacent segments, but whether this could be done would depend upon the degree of flexibility which thicker segments would have.

In FIGS. 1 to 3, the shroud segments and vanes 5 and 11 are shown as being supported by a carrier ring, which in turn is suspended from a casing member 19. However, it would be possible in suitable cases to dispense with the carrier ring as a separate component and support the shroud segments, as well as the stator blades, directly from a thicker casing member having suitable location, retaining and sealing features machined into it.

Although the embodiments of the invention have been described as accommodating the effects of manufacturing tolerances, or the effects of manufacturing tolerances plus the effects of differential expansion, it will be apparent that the embodiments could be designed to accommodate the effects of differential expansion only, e.g. in a case in which losses of efficiency caused by clearances due to manufacturing tolerances are negligible or unimportant.

I claim:

1. For an axial flow compressor rotor, a shroud assembly comprising:

a shroud ring comprising a plurality of shroud segments of unitary structure, said shroud segments being resiliently deformable, each of said shroud segments having front, intermediate and rear edge portions extending circumferentially of said shroud ring, said front and rear edge portions forming radially inner portions relative to said intermediate portion of said shroud segments;

supporting structure circumferentially surrounding said shroud ring, said supporting structure having portions thereof in circumferential and axial sealing contact with said front and rear edge portions of said shroud segments thereby to form a circumferentially and axially extending seal therebetween; and means retaining said shroud segments to said supporting structure with said front and rear edge portions forming said radially inner portions of said shroud segments being sprung radially outwardly against and into the circumferential and axial sealing contact with said supporting structure, whereby said shroud segments are held in said shroud assembly in a resiliently deformed condition.

2. A shroud assembly as claimed in claim 1, said shroud assembly being subject to dimensional variations within manufacturing tolerances, which dimensional variations tend to reduce said resiliently deformed condition of said shroud segments; wherein said shroud segments are retained to said supporting structure such that said resiliently deformed condition is sufficient to maintain said sealing contact between said supporting structure and said shroud segments against reductions in said resiliently deformed condition caused by said dimensional variations.

3. A shroud assembly as claimed in claim 1, said shroud assembly being subject to differential thermal expansion during operation of said compressor rotor, which differential thermal expansion tends to reduce said resiliently deformed condition of said shroud segments; wherein said shroud segments are retained to said supporting structure such that said resiliently deformed condition is sufficient to maintain said sealing contact between said supporting structure and said shroud segments against at least some of the reductions in said resiliently deformed condition caused by said differential thermal expansion.

4. A shroud assembly as claimed in claim 1 in which said means retaining said shroud segments to said supporting structure is positioned centrally of said shroud segments with respect to said front and rear edge portions into said sealing contact with said supporting structure and distribute said resiliently deformed condition of said shroud segments over substantially the entire axial extent thereof.

5. A shroud assembly as claimed in claim 1 in which said means retaining said shroud segments to said supporting structure is positioned near said front and rear edge portions, which means acts to pull said front and rear edge portions into said sealing contact with said supporting structure and confine said resiliently deformed condition of said shroud segments substantially to said front and rear edge portions thereof.

6. For an axial flow compressor rotor, a shroud assembly comprising:

a shroud ring comprising a plurality of resiliently deformable shroud segments, each of said shroud segments having front and rear edge portions extending circumferentially of said shroud ring, said front and rear edge portions forming radially inner portions of said shroud segments and said front and rear portions being thinner than other portions of said shroud segments;

supporting structure circumferentially surrounding said shroud ring, said supporting structure having portions thereof in sealing contact with said front and rear edge portions of said shroud segments thereby to form a circumferentially extending seal therebetween;

means retaining said shroud segments to said supporting structure with said front and rear edge portions forming said radially inner portions of said shroud segments being sprung radially outwardly against and into sealing contact with said supporting structure, whereby said shroud segments are held in said shroud assembly in a resiliently deformed condition, at least most of said resiliently deformed condition of said shroud segments occurring as deformation of said front and rear edge portions.

* * * * *